United States Patent [19]

Rolfes

[11] 4,162,803

[45] Jul. 31, 1979

[54] LATCH RELEASE DEVICE

[76] Inventor: J. Kenneth Rolfes, 216½ 13th Ave., NE. St., Petersburg, Fla. 33701

[21] Appl. No.: 859,231

[22] Filed: Dec. 9, 1977

[51] Int. Cl.[2] ..... B66C 1/38

[52] U.S. Cl. ..... 294/83 R

[58] Field of Search ..... 294/83 R, 83 A, 83 AB, 294/82 R, 75, 84; 89/1.5 R, 1.5 G; 244/137 R; 43/8, 9; 403/328, 348

[56] References Cited

U.S. PATENT DOCUMENTS

| | | | |
|---|---|---|---|
| 3,845,978 | 11/1974 | Huber | 294/83 R |
| 3,926,467 | 12/1975 | Crissy et al. | 294/83 R |

*Primary Examiner*—James B. Marbert

*Attorney, Agent, or Firm*—Duckworth, Hobby, Allen & Pettis

[57] ABSTRACT

A latch release device operated by a mechanical impulse and constructed so as to sequentially release a plurality of latches in response to a corresponding plurality of mechanical forces. Operation of the latch release device is accomplished by a single operating arm and a single trigger bar in combination with a plurality of sears corresponding to the plurality of latches provided. The device is particularly useful for releasing individual loads at a remote location in response to individual mechanical forces such as may be provided by a messenger weight.

14 Claims, 5 Drawing Figures

LATCH RELEASE DEVICE

BACKGROUND OF THE INVENTION

1. Field of the Invention

The present invention relates to a latch release device which is mechanically actuated and may be utilized to release a plurality of loads sequentially, in response to a corresponding plurality of mechanical impulses.

2. Description of the Prior Art

Numerous constructions for locking cargo hooks and mechanical devices for releasing those hooks are known in the prior art. These devices have been constructed in direct response to the need for positively retaining and then releasing a static load. Such devices are frequently associated with the building trades and with the shipping industry. Large hooks are utilized to secure, lift and move a load, and then remote means are utilized to release the hook's grasp on the material.

Devices of this type are exemplified in the prior art by U.S. Pat. Nos. 2,577,790; 3,578,373; and 3,630,562. These patents all teach constructions for locking hook mechanisms, and the last two patents also teach a structure whereby the hook can be remotely released.

Of course, sub-species of latches which are remotely releasable have developed in the art. One such sub-species is commonly found within the technical area concerning oceanographic research. Oceanographic research techniques often require that various sensing, collecting and/or testing devices be released at predetermined depths. To accomplish this result, and to reduce the cost of research hardware, plural latch, sequential release devices have been constructed. Two exemplar such devices are shown in U.S. Pat. Nos. 3,412,498 and 3,729,855, both to Niskin. Each of these patents disclose retaining mechanisms for holding a plurality of objects and sequentially releasing those objects in a remote fashion.

Accordingly, it is clear that there is a great need in the art for latch mechanisms which are capable not only of retaining a plurality of loads, but also of releasing those loads in a predetermined, sequential fashion. Presuming that such devices will often be utilized in the area of oceanographic research, it is clear that they will be subject to extremely deleterious environmental conditions such as salt water, extreme temperature changes, and relatively rough handling. It is primarily with these objects in mind that the present invention has been developed.

While the present invention is contemplated as being quite useful in the area of oceanographic research, the invention is certainly not to be limited thereto. The latch release device of the present invention is suitable for use in virtually any environment wherein it is desired to retain one or a plurality of loads and to release those loads in response to a predetermined remote command.

SUMMARY OF THE INVENTION

The present invention relates to a latch release device suitable for retaining a single load or a plurality of discreet loads and includes mechanism responsive to a mechanical force for releasing the load, or loads, retained thereby. In a preferred embodiment of the invention, construction details of which will be presented hereinafter, the device is constructed so as to retain and sequentially release two discrete objects. It is to be understood that the latch release device can be constructed so as to provide for a single or a plurality of loads. It is furthermore to be understood that the latch release device and the loads retained thereby would be connected to a supporting object such as, for example, a ship or a crane, by a line or cable.

Inasmuch as the latch release device is mechanical in its construction and operation, it is desirable to retain the internal moving parts within a housing so as to protect those moving parts from adverse environment conditions. Formed at the top of the housing, with respect to the bottom of the device for which the loads depend, is an operating arm. The supporting cable on which the device is mounted passes through one end of the operating arm so that the device may be actuated by mechanical impulses delivered along the cable. These impulses are preferrably transmitted by weights, commonly referred to as messengers, which are allowed to fall down the cable onto the operating arm.

The mechanical impulse of a messenger striking the operating arm causes movement of that arm which is translated into a corresponding movement of the trigger bar operatively disposed within the housing. The trigger bar, in turn, moves so as to pivot a sear which is normally disposed in a locking relation to a latch. Movement of the sear releases the latch and, therefor, releases the load depending therefrom.

In the preferred embodiment of the latch release device a pair of latches and a corresponding pair of sears are utilized so as to retain two distinct loads. The trigger bar includes thereon a pair of trigger cams operatively disposed with regard to corresponding sear cams disposed on each of the two sears.

A first mechanical impulse directed to the operating arm causes movement of the trigger bar so as to engage a first trigger cam with a corresponding first sear cam to release the first latch. A second mechanical impulse causes movement of the trigger bar so as to engage the second sear cam with the second trigger cam to release the second latch.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
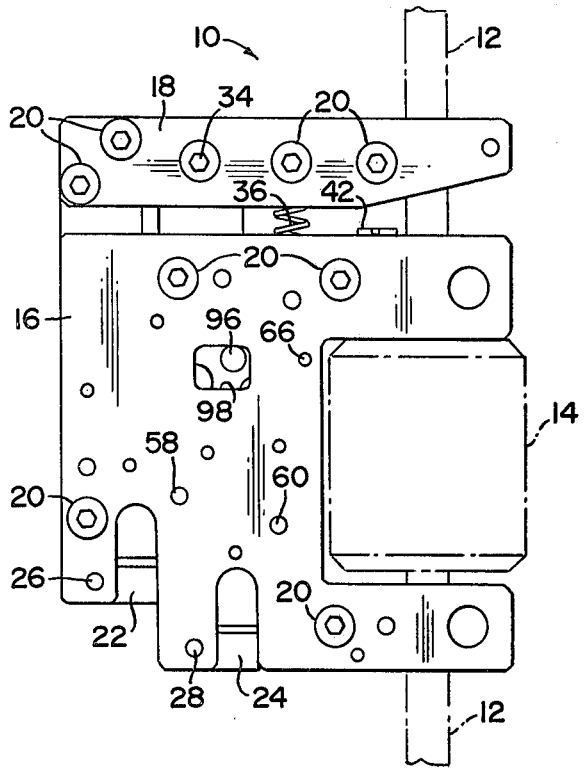
FIG. 1 is a front elevational view of the preferred embodiment of the latch release device.

The present invention relates to a latch release device generally indicated as 10 in the drawing figures and shown therein as a preferred embodiment comprising two latch mechanisms. The view of FIG. 1 illustrates device 10 in its operative condition being attached to a cable 12 and retained thereon by wire clamp 14. Latch release device 10 is enclosed by a housing comprising front plate 16 and front arm plate 18. Corresponding back plates (not shown) are also provided. The housing plates are secured to each other by standard fastening means such as, for example, bolts 20 shown in FIG. 1. The views of FIGS. 2–5 illustrate device 10 with front plate 16 and front arm plate 18 removed so as to reveal the operative elements of device 10. Nevertheless, two operative elements of device 10 are visible in the view of FIG. 1 and are identified as first latch means 22 and second latch means 24. As will be described in greater detail below, first and second latch means 22 and 24 are pivotaly connected to the housing of device 10 as by pivot pins 26 and 28, respectively.

Figure 2:
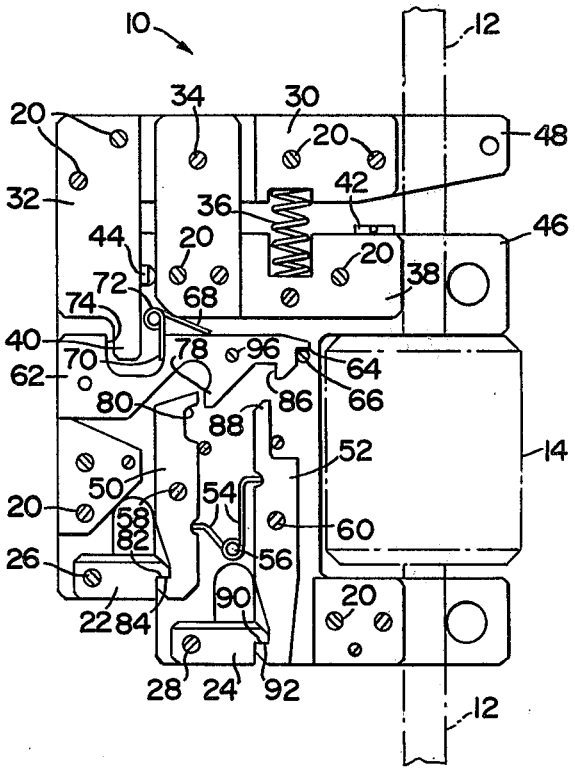
FIG. 2 is a front elevational view similar to that of FIG. 1 with portions of the housing removed and illustrating the latch release device in its ready position.

Attention is now invited to the view of FIG. 2 wherein device 10 is shown with front plate 16 and front arm plate 18 removed. Therein it can be seen that an operating arm means including a first leg 30 and a second leg 32 is movably disposed on the housing as at pivot point 34. An operating arm biasing means 36 is disposed between a portion 38 of the housing and first leg 30 so as to normally urge the operating arm means into the position shown in FIG. 2. At this point it should also be noted that second leg 32 of the operating arm means includes an operating finger 40 formed thereon. Finally, first adjustable stop 42 and second adjustable stop 44 are provided so as to limit the motion of the operating arm means and will be described in greater detail below. It is also to be noted that in the view of FIGS. 2–5 portions of housing rear plate 46 and rear arm plate 48 are visible.

As previously described, and as now clearly visible in the view of FIG. 2, this preferred embodiment further comprises first latch means 22 and second latch means 24. As shown in the view of FIG. 2, first latch 22 and second latch 24 are normally retained in a locked, closed position by first sear means 50 and second sear means 52, respectively. First sear means 50 and second sear means 52 are urged into the positions illustrated in FIG. 2 by sear biasing means 54 attached to rear plate 46 as at pin 56. First sear means 50 is pivotally attached to rear plate 46 by first sear pivot pin 58, and second sear means 52 is similarly disposed at second sear pivot pin 60.

Immediately above first and second sear means 50 and 52, and immediately below operating finger 40 of second leg 32 of the operating arm means is trigger bar means 62 of the present invention. A shoulder means 64 is formed on the interior end of trigger bar means 62, and shoulder means 64 operatively engages disconnector pin means 66 when device 10 is in the ready position illustrated in FIG. 2. Trigger bar means 62 is normally maintained in the position shown in FIG. 2 by the force of arms 68 and 70 and trigger biasing means 72.

Finally, it should be noted that trigger bar means 62 further comprises receiver means defined by groove 74 formed thereon in receiving relation to at least a portion of operating finger 40.

Figure 3:
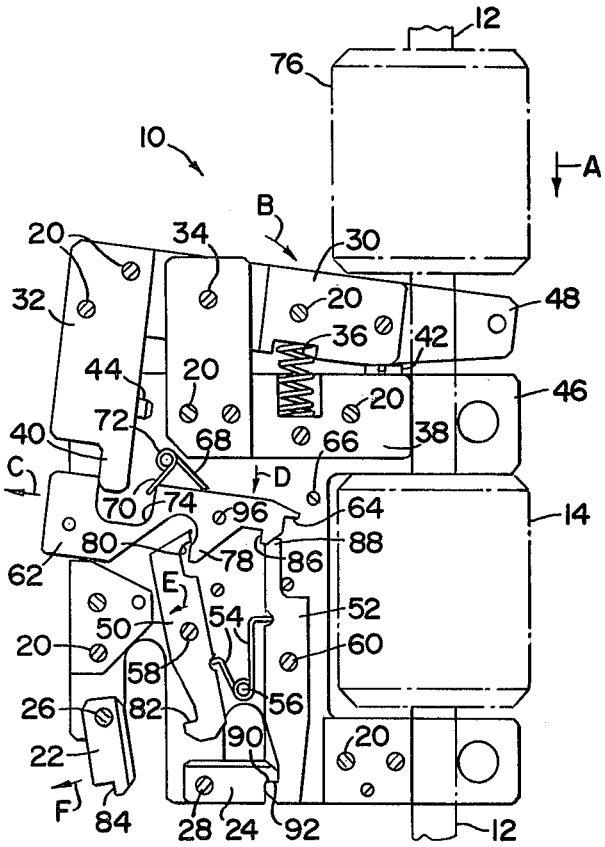
FIG. 3 illustrates the latch release device in its operative position to release the first latch following a first mechanical impulse.

Attention is now invited to the view of FIG. 3 wherein a first actuation of device 10 is illustrated showing the operative elements in position to release, or open, first latch means 22. As indicated by directional arrow A, a mechanical force is delivered to first leg 30 of the operating arm as by a messenger weight 76. This depresses first leg 30 in the direction shown by arrow B, pivots the operating arm around pivot point 34, moving second leg 32 into the position illustrated. In the position illustrated in FIG. 3, it can be seen that operating finger 30 will engage a portion of groove 74 thereby shifting trigger bar means 62 in the direction indicated by arrow C. This movement of trigger bar means 62 causes shoulder 64 to disengage from disconnector pin means 66 resulting in a downward motion of trigger bar means 62 as indicated by arrow D and directly resulting from the relatively downward biasing force of arm 68 of trigger biasing means 72.

In this position first trigger cam 78 will engage first sear cam 80 causing first sear means 50 to pivot about first sear pivot pin 58 as indicated by directional arrow E. This necessarily releases first sear tip 82 from first latch shoulder 84 allowing first latch means 22 to open as indicated by directional arrow F. At this point it should be noted that the camming engagement between first trigger cam 78 and first sear cam 80 is such that trigger bar means 62 does not operatively engage second sear means 52.

Figure 4:
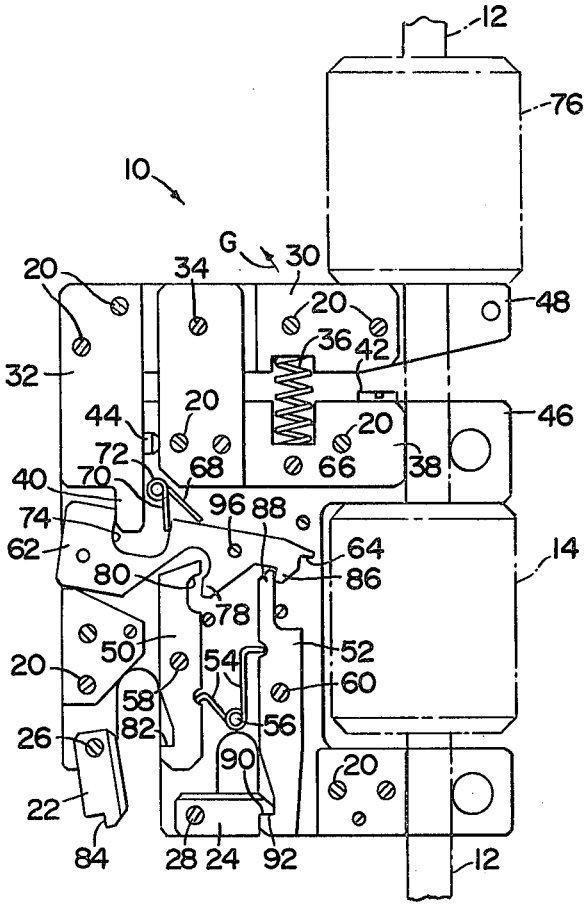
FIG. 4 illustrates the latch release device in its second ready position.

The view of FIG. 4 illustrates the position of the elements of device 10 just after the impact of messenger weight 76. As shown therein, the force of operating arm biasing means 36 raises first leg 30 of the operating arm means as indicated by directional arrow G, resulting in a corresponding repositioning of second leg 32. It should also be noted that the biasing force of arm 70 of trigger biasing means 72 has repositioned trigger bar means 62 so as to place second trigger cam 86 into abutting relation with the second sear cam 88. In a similar fashion, sear biasing means 54 has returned first sear means 50 to a substantially vertical position. Of course, in the position shown in FIG. 4, second latch means 24 is maintained in a closed locked position by the abutting engagement between second sear tip 90 and second latch shoulder 92.

Figure 5:
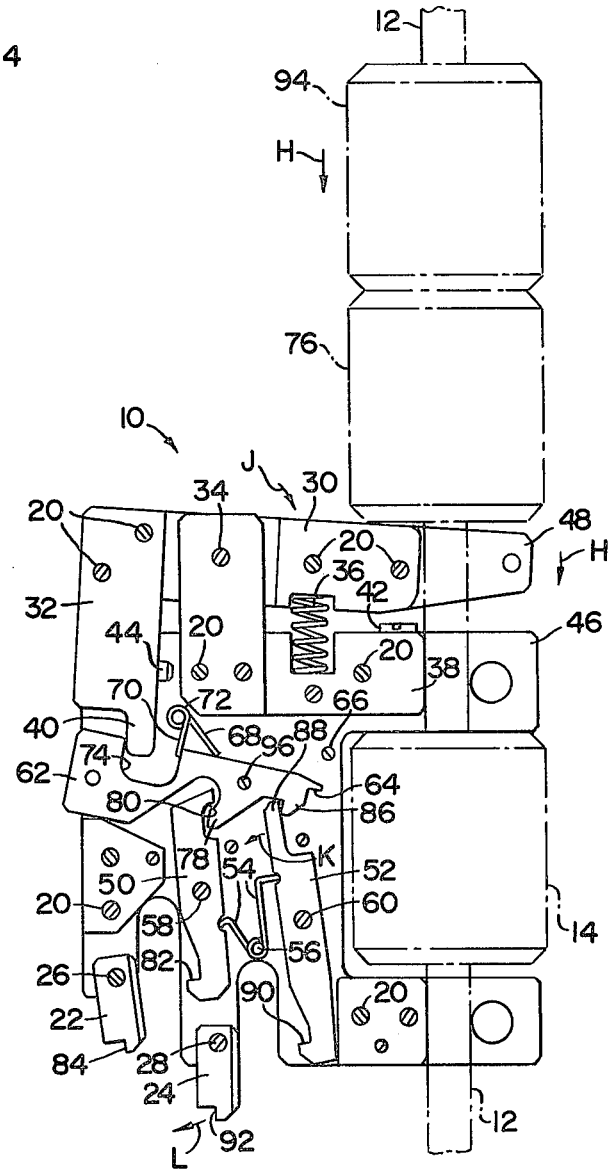
FIG. 5 illustrates the latch release device operatively disposed to release the second latch after receiving a second mechanical impulse.

Then, with specific regard to the view of FIG. 5, the operative position of each of the elements of device 10 is shown so as to release second latch means 24 in direct response to the mechanical impulse of second messenger weight 94 being delivered in the direction indicated by arrows H. Once second messenger weight 94 strikes messenger weight 76, first leg 30 of the operating arm means will be depressed in the direction indicated by arrow J. This causes correponsing movement of second leg 32 resulting in engagement of operating finger 40 with groove 74 of trigger bar means 62. Because of the relatively downward force of arm 68 of trigger biasing means 72, and the engagement between second trigger cam 86 and second sear cam 88, second sear means 52 is rotated about pivot point 60 as indicated by directional arrow K. Accordingly, second sear tip 90 is removed from second latch shoulder 92, and second latch means 24 opens by rotating about pivot pin 28 as indicated by arrow L.

Device 10 may then be reset to the position shown in the views of FIGS. 1 and 2, by slightly depressing first leg 30 and repositioning trigger bar means 62 by manipulating reset pin 96 attached to trigger bar means 62 and extending outwardly from device 10 through reset aperture 98 formed in front plate 16 of the housing. Then first latch means 22 and second latch means 24 are merely raised into their closed, locked positions. This is possible by simple exerting sufficient pressure to overcome the biasing force exerted by sear biasing means 54.

While the above detailed description has been given with specific regard to a preferred embodiment including a pair of latch means, it is to be understood that device 10 may be constructed to include a single latch means or, in the alternative, a plurality of latch means. All that is necessary in order to construct a device 10 having more than two latches is to make slight modification in the construction and placement of trigger bar means 62. Furthermore, while this detailed description has related the use of messenger weights 76 and 94 for the purpose of providing the necessary mechanical impulse to operate device 10 so as to release the latches 22 and 24, other means may be utilized. The scope of the present invention certainly is not limited to the use of messenger weights.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpretted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A latch release device responsive to a mechanical force comprising, in combination: a latch housing; operating arm means movably disposed on said housing and disposed to receive a mechanical impulse; first latch means pivotally attached to said housing; first sear means movably disposed on said housing in engaging relation to said first latch means whereby said first latch means is normally retained in a closed position; sear biasing means operatively disposed between said housing and said first sear means, whereby said first sear means is normally urged to a retaining relation with said first latch means; and trigger bar means disposed in movable interconnecting relation between said operating arm means and said first sear means whereby a mechanical force directed to said operating arm means will be transmitted to said first sear means to overcome said sear biasing means and open said first latch means.

2. A latch release device as in claim 1 further comprising operating arm biasing means operatively disposed between said housing and said operating arm means, whereby said operating arm means is normally urged to a ready position.

3. A latch release device as in claim 1 further comprising trigger biasing means operatively disposed between said housing and said trigger bar means, whereby said trigger bar means is normally urged to an engaging relation with said first sear means when said operating arm means is actuated by a mechanical impulse.

4. A latch release device as in claim 1 wherein said operating arm means further comprises operating finger means formed thereon; and wherein said trigger bar means further comprises receiver means formed thereon; said finger means being disposed at least partially within said receiver means, whereby a force directed to said operating arm means will be mechanically transmitted to said trigger bar means.

5. A latch release device as in claim 4 wherein said trigger bar means further comprises shoulder means formed thereon, and wherein said release device further comprises disconnector pin means disposed on said housing; said disconnector pin means engaging said shoulder means so as to retain said trigger bar means in a spaced apart position with relation to said first sear means when said release device is in a ready position.

6. A latch release device as in claim 5 wherein said trigger bar means further comprises first trigger cam means formed thereon, and wherein said first sear means further comprises first sear cam means formed thereon; said first trigger cam means and said first sear cam means being operatively disposed in engaging relation to each other, whereby actuation of said trigger bar means by said operating arms means will result in movement of said first sear means to release said first latch means.

7. A latch release device as in claim 1 further comprising: a second latch means pivotally attached to said housing; and second sear means movably disposed on said housing in engaging relation to said second latch means whereby said second latch means is normally retained in a closed position; said trigger bar means being disposed in movable, sequentially interconnecting relation between said operating arm means and said first and said second sear means whereby two discrete mechanical forces directed to said operating arm means will be transmitted first to said first sear means and second to said second sear means to open said first and said second latch means sequentially.

8. A latch release device as in claim 7 further comprising operating arm biasing means operatively disposed between said housing and said operating arm means, whereby said operating arms means is normally urged to a ready position.

9. A latch release device as in claim 7 further comprising trigger biasing means operatively disposed between said housing and said trigger bar means, whereby said trigger bar means is normally urged to an engaging relation with said first sear means when said operating arm means is actuated by a first mechanical impulse and to an engaging relation with said second sear means when said operating arm means is actuated by a second mechanical force.

10. A latch release device as in claim 7 further comprising sear baising means operatively disposed between said housing and said first and said second sear means, whereby said first and said second sear means are normally urged to a retaining relation with respect to corresponding said first and said second latch means.

11. A latch release device as in claim 7 wherein said operating arm means further comprises operating finger means formed thereon, and wherein said trigger bar means further comprises receiver means formed thereoh; said finger means being disposed at least partially within said receiver means, whereby a force directed to said operating arm means will be mechanicaly transmitted to said trigger bar means.

12. A latch release device as in claim 11 wherein said trigger bar means further comprises shoulder means formed thereon, and wherein said release device further comprises disconnector pin means disposed on said housing; said disconnector pin means engaging said shoulder means so as to retain said trigger bar means in a disconnect position with relation to said second sear means when said release device is in its ready position until said release device is in its second ready position.

13. A latch release device as in claim 12 wherein said trigger bar means further comprises first and second trigger cam means formed thereon, and wherein said first and said second sear means further comprise corresponding first and second sear cam means forward thereon; said first and second trigger cam means and said first and second sear cam means being operatively disposed in engaging relation to each other, whereby a first actuation of said trigger bar means by said operating arm means will result in movement of said first sear to release said first latch means and whereby a second actuation of said trigger bar means by said operating arm means will result in movement of said second sear means to release said second latch means.

14. A latch release device responsive to mechanical forces comprising, in combination: a latch housing; operating arm means movably disposed on said housing and disposed to receive mechanical impulses; a plurality of latch means typically attached to said housing; a corresponding plurality of sear means movably disposed on said housing, each one of said plurality of said sear means being in engaging relation to a corresponding one of said plurality of said latch means whereby each of said latch means is normally retained in a closed position; and trigger bar means disposed in movable interconnecting relation between said operating arm means and said plurality of said sear means whereby a plurality of mechanical forces direced to said operating arm means will be transmitted sequentially to successive ones of said plurality of said sear means to sequentially open said corresponding plurality of said latch means.

* * * * *

UNITED STATES PATENT AND TRADEMARK OFFICE

CERTIFICATE OF CORRECTION

PATENT NO. : 4,162,803

DATED : July 31, 1979

INVENTOR(S) : J. Kenneth Rolfes

It is certified that error appears in the above-identified patent and that said Letters Patent are hereby corrected as shown below:

Claim 11, line 58, delete "thereoh" and insert therefor--thereon--.

Claim 11, line 60, delete "mechanicaly" and insert therefor--mechanically--.

Claim 13, line 7, delete "forward" and insert therefor--formed--.

Claim 14, line 14, delete "direced" and insert therefor--directed--.

Signed and Sealed this

*Seventeenth* Day of *November 1981*

[SEAL]

*Attest:*

GERALD J. MOSSINGHOFF

*Attesting Officer*

*Commissioner of Patents and Trademarks*